United States Patent [19]

Nation

[11] 4,158,283

[45] Jun. 19, 1979

[54] CABLE STRESS AND FATIGUE CONTROL

[76] Inventor: Milton A. Nation, 905 Moraga Dr., Los Angeles, Calif. 90049

[21] Appl. No.: 757,300

[22] Filed: Jan. 5, 1977

[51] Int. Cl.[2] ..... D07B 5/00

[52] U.S. Cl. ..... 57/200; 75/175.5; 148/11.5 R

[58] Field of Search ..... 57/139, 145, 147, 148, 57/166; 148/11.5 F, 12.7; 75/151, 175.5; 72/200, 365, 700; 29/423, 193, 424; 74/129 R

[56] References Cited

U.S. PATENT DOCUMENTS

| | | | |
|---|---|---|---|
| 3,194,693 | 7/1965 | Soltis | 148/11.5 F X |
| 3,511,622 | 5/1970 | Nation | 57/166 X |
| 3,511,719 | 7/1970 | Nation | 148/11.5 F |
| 3,527,044 | 9/1970 | Nation | 148/11.5 F X |
| 3,532,559 | 10/1970 | Gullotti et al. | 148/11.5 F |
| 3,575,736 | 4/1971 | Fitzpatrick et al. | 148/11.5 F |
| 3,584,368 | 6/1971 | Sargent | 148/11.5 F X |
| 3,686,041 | 8/1972 | Lee | 148/11.5 R |
| 4,010,046 | 3/1977 | Setzer | 148/11.5 A |
| 4,067,734 | 1/1978 | Curtis | 75/175.5 |

*Primary Examiner*—Donald Watkins

[57] ABSTRACT

Titanium aluminum, non-frangible structural wire, when assembled into axially symmetric and contrahelically wrapped cable has high fatigue strength and loading linearity for uniquely high work efficiency. Dynamic stresses are moderated by more suitable mechanical, physical and dynamic properties so that stress and fatigue control are passively achieved. Structural wire is specially processed from selected titanium base alloys having high drop test tear energy, wherein new construction designs and specifications are then suitable and used during cable assembly to substantially advance work performance and increase service life.

Work characteristics are basically improved and changed by (1) adding elastic and constructional stretch, (2) materially reducing mass density, and (3) loading cable with hard and soft spring. These cable attributes translate into much higher fatigue strength, mainly by absorbing, storing and dissipating induced work loads at rapid rates.

A new construction characteristic is enlarged cores for both structural and electrical reasons wherein stress stratification, stress transfer and distribution between layers, and stress propagation and vibration are changed, wherein stretch is increased and loading dynamically counterbalanced. Internal stresses are also reduced in the interrelated process by greater component compliance.

Variably designed core and outer strand constructions including composite cable are used to increase work capacity and service life, and to reduce cost. Non-frangible, aluminum wire may be used as components in cable constructions, interchangeably with titanium wire as conductor and structural components in many cases in this invention.

11 Claims, 5 Drawing Figures

ENLARGED CORE (1x19) AXIALLY SYMMETRIC CABLE

8 OUTER STRANDS (1x9)

ENLARGED CORE (1x19) R.H. CONTRA HELICAL CONSTRUCTION

16 INNER WIRES (R.H.)

24 OUTER WIRES (L.H.)

COMPARISON SHOCK AMPLITUDE

CABLE STRESS AND FATIGUE CONTROL

BACKGROUND OF INVENTION

Figure 1:
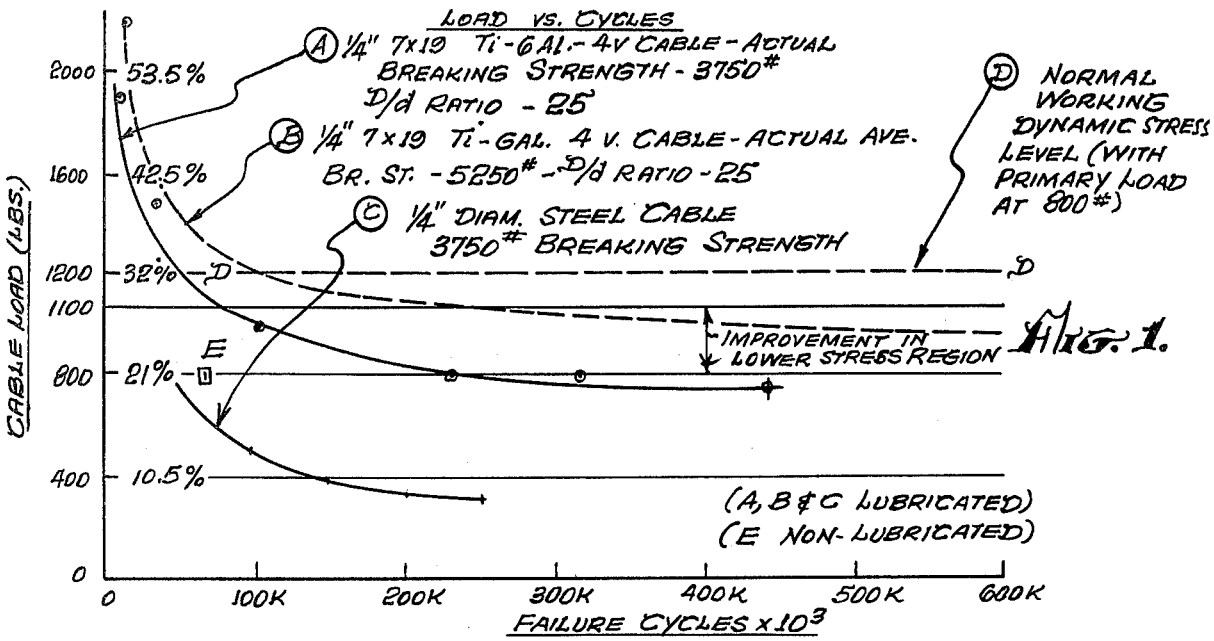

This invention relates to stress and fatigue control of cable, especially for titanium (ti) and aluminum (al) cable, while performing much greater amounts of useful work, primarily in materials handling systems. Two (2) additional patent applications are submitted herewith: (1) Fail-Safe Cable and the Effect of Non-Frangible Wire in Cable Structures, Ser. No. 757,551, and (2) Deep Well Handling and Logging Cable, Ser. No. 757,552. The three (3) patent applications are copending.

Three (3) physical phenomena: fracture, fatigue and wear occur to varying degrees in cable tension systems especially those in the broad materials handling category. These phenomena have dominant, and often progressive degrading effects, while to a much lesser extent, corrosion, stress corrosion, strain hardening and fretting fatigue normally have lower degrading affects while environments also have a pronounced influence. Because of titanium attributes, specially selected and processed titanium base alloy wire, assembled into titanium cable following suitable construction design criteria including novel counterbalancing, overcome or moderate these degrading effects when used in work performing tension systems. Al cable attributes are very similar in stress and fatigue control but in regard to these physical phenomena, results are different.

As examples of titanium wire and cable attributes, patent application file Ser. No. 707,951 relates to neutralization of wear while U.S. Pat. Nos. 3,527,044, 3,511,622 and 3,511,719 describe ti structural wire and cable and their uses, one being a process and one being an article patent.

Steel wire and cable are noted for rapid fatigue especially in worn and case hardened areas in the cable assembly. At points where the wire of one strand cross those of another strand at an angle, wire pressure and relative movement between wires cause sawing and case hardening. Under repeated bending, dynamic stressing under work load causes rapid wear and fatigue; notches wear in the wires at points of cross wire contact that leads to both wear and fatigue fractures, and progressive, and even rapid failure of the cable.

This physical notching characteristic with attendant case hardening and embrittlement, causes rapid fatigue under bending action. Conventional factors of safety in handling systems then range from 3 to 11 in practice, the latter being for elevators due to the premium that must be placed on personnel safety.

This safety approach while providing much more than adequate strength, increases cable stiffness, internal wear, and adds mass. The stiffness problem is overcome by using small (diam.) wires to provide flexibility, the essential system handling characteristic; but sliding friction and wire pressure between wires are increased because of increased mass and the high modulii of elasticity of wire and cable. Cable flexibility is then a function of wire size and elasticity as well as frictional stiffness; one is then concerned with both elastic and frictional stiffness in steel materials handling systems. Complex symmetry of massive old cable constructions degrades cable performance and specifically results in high internal stresses and low fatigue life.

Four (4) dynamic factors (stresses) in cable tension systems, known to induce abnormally rapid fatigue, are:

1. Impact stress (denoted by the formula, $\sigma i = v\text{-}o\sqrt{E_c x \rho_c}$) causes tension peaks sufficiently high to exceed the elastic limit so as to overstress the cable or some of the wires in the cable. Wire fractures, or overstressing (even cable fracture) frequently occur in high stress regions due to low dynamic properties of steel wire.

2. Bend stresses (denoted by the formula $\sigma b = (\delta/D) \cdot E$) may be sufficient to cause plastic flow if the sheave or drum diameter is small enough.

3. Surface contact stress ($\sigma c = 4580\sqrt{P}$) causes rapid fatigue because of the large pressure constant derived from dynamic factors of mass density ($\rho$) and tension (T).

4. The total of characteristic dynamic stresses, when performing work especially including wire pressure and surface contact stresses, may be high enough to, cumulatively, cause fatigue from high tension peaks and even rapid fatigue from plastic flow denoted by wire notching or flattening. Severe impact stresses, also, may fracture the tension member as well as overstress it. Fatigue effects are severest in bend stress regions and near points of impact stresses of tension systems as shown in long cycle testing primarily in the lower stress region.

The cumulative values of dynamic stresses are calculated and tabulated hereinafter to show why rapid fatigue occurs in steel cables.

Continuous stress vibration of tension members, particularly notable in shock environments, adds constantly to fatigue accumulation. This vibratory fatigue is least in air, among the fluids, but may become quite severe in deep ocean steel moorings. Wire cross sections are markedly deformed by constant low order impacting from this vibratory phenomenon.

Strain hardening, as it operates in the plastic load range of wire, is known to fatigue steel to a much greater extent than ti upon which this phenomenon has little effect.

SUMMARY OF INVENTION

Accordingly it is an object of this invention to select and process ti and al wire and construct ti and al cable with high fatigue strength and low dynamic stresses.

A further object is to provide ti and al cable for tension systems in which fatigue control is passively used to provide protracted and reliable service in common environments.

Another object of this invention is to provide ti and al wire with high dynamic properties and ti and al cable having low dynamic stresses while performing work, primarily bend, impact, and contact (Hertzian) stresses.

Further object is to process ti and al structural wire having high hard spring and construct ti and al cable with high soft spring so that energy dissipation capacity is high while performing work.

Still another object is to combine fatigue control with low wear rates to reliably perform work over protracted periods with ti and al cable in tension systems together with thin, solid film lubricant.

A final object is to combine the attributes of ti and al wire and cable with other selected wires and fibres having a range of properties suitable for use in tension systems from which to construct composite cables in order to optimize performance and cost. This objective includes electromechanical cable for numerous uses including well logging.

As a result of aforementioned problems and limitations of steel wire and cable, primary loads are normally limited to either one-fifth (1/5) or one-sixth (1/6) of the ultimate cable strength. Both commonly used steel materials, carbon and stainless (corrosion resistant) are non-linear in load deflection. Thus fatigue accelerates from the combination of tension peaks and loads in excess of the above mentioned limits, primarily caused by high tension peaks in non-linear material.

However load deflection attributes of ti and al wire are (1) low dynamic stresses, (in practice about one-half to one-quarter of steel), (2) small gaps between yield and ultimate strengths, (3) linear load deflection, and (4) high resistance to strain hardening. In terms of fatigue control in the lower stress region, fatigue is at an extremely slow rate and overstressing does not occur, while in the higher stress region overstressing should not occur except perhaps in core strands, and this fatigue effect is also extremely limited, noting the effectiveness of counterbalancing in dissipating dynamic loading. Likewise in the lower stress region wear is normally confined to mild wear, whereas in the upper stress region wear is severe including both ti and al.

The following is a composite tabulation of physical data to illustrate the difference in mechanical properties of commonly used alloys of these two basic materials especially noting the gaps between yield and ultimate strengths:

| MATERIAL STRENGTH | YIELD STRENGTH | ULTIMATE STRENGTH | ELONG % | REDUCTION IN AREA |
|---|---|---|---|---|
| T1-6A-4V | 125 psi | 135 psi | 13 | 40 |
| T1-13V-11Cr-3A1 | 150 | 172 | 25 | 70 |
| T1-13V-11Cr-3A1 (aged) | 175 | 185 | 18 | 40 |
| 6061-T651 | 41.5 | 46.9 | 13 | 33 |
| 7005-T63451 | 48.5 | 55.6 | 16 | 37 |
| 1035 carbon steel | 50 | 85 | 25 | ( ) 55 |
| T302 Stainless | 35 | 85 | 50 | 60 |

Titanium alloys consist of greater or lesser amounts of the alpha ($\alpha$) phase (h.c.p.) and beta ($\beta$) phase (b.c.c.). The former phase is inherently less ductile with less capacity for strain than the latter phase, and conversely the alpha ($\alpha$) phase exhibits a higher strain hardening rate than the beta ($\beta$) phase. However neither phase strain hardens nearly as rapidly as the steels. Strain hardening prevents further damage by microyielding.

Figure 2:
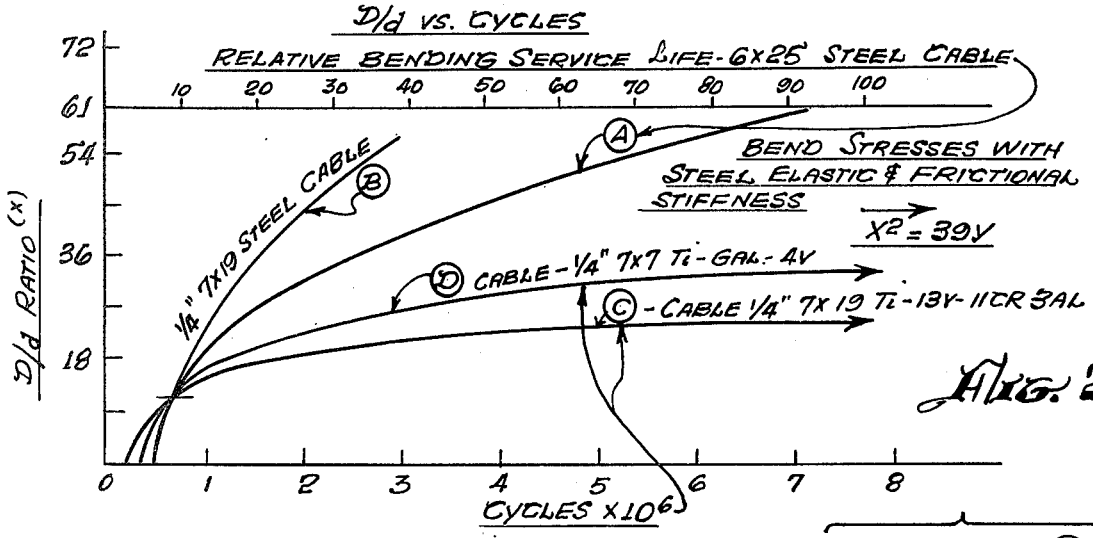
Figure 3A:
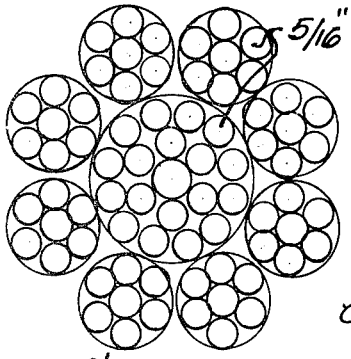
Figure 3B:
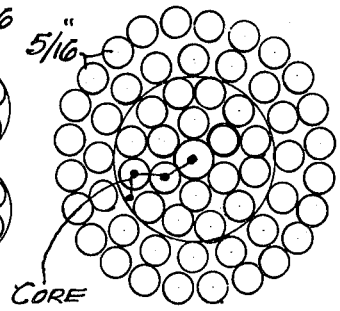
Figure 4:
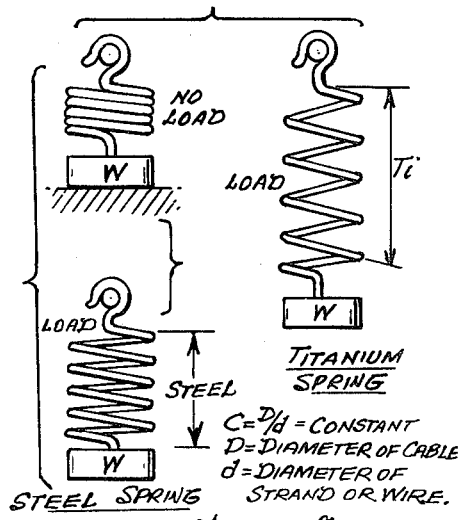

However fatigue performance is found to be related to dynamic properties (mass density and modulus of elasticity), and ultimate tensile strength (u.t.s.) in tension systems, noting above that titanium tension member stresses are, characteristically, about one-half steel stresses; fatigue performance of ti cable is superior to steel due to distinct linearity of loading and the narrow gap between yield and ultimate strengths, as tabulated above and shown in ti load deflection diagrams shown in FIGS. 2, 3 & 4, Ser. No. 757,300, wherein (a) tension peaks in steel cable reach the elastic limit to overstress with at least a doubling effect compared to the same dynamic action in an identical titanium cable; and (b) the strain hardening rate is much greater in steels. Al wire and cable compares with ti in load deflection except for much lower tensile strength.

It may now be seen that fatigue action in steel, and in ti and al cables is characteristically different and is at much higher rates in steel cable. Further to fatigue in titanium cable, the novel counterbalancing action design of the soft spring moderates tension peaks (while dissipating energy) including stress vibration in shock environments so that the dynamic stress level is moderated and suppressed in forming peaks. This dominant spring action, together with energy absorbing and storing for energy interchange, is effective in maintaining dynamic stresses in the lower stress region when tension systems are not overloaded.

DEFINITIONS

The following definitions provide more precise understanding of the invention:

(a) Dynamic tear energy is a relative index of an advanced engineering test wherein energy/area ratios are plotted against crack extension values.

(b) Fatigue of metals is a microstructural process in which unbonding of atoms occurs along slip planes that may take zigzag patterns. Two (2) special types of fatigue of concern and (1) fretting fatigue which implies that a fatigue crack occurs in a region where there is surface contact between two (2) separate bodies involving pressure, and (2) bend fatigue exists when there is continuous alternation of stresses, accompanied by reversed plastic strain under cyclic loading.

(c) Lower stress region is the specific lower part of the loading range in which tension operates from the lowest dynamic state above static repose to one-half of the rated ultimate strength of the cable wherein the load limit is normally confined to one-fifth (1/5) of this ultimate strength, for practical purposes, as shown on FIG. 1.

(d) Upper stress region is the remaining upper part of the stress region so as to cover tension peaks to the elastic limit, and primary loading greater than 20% (1/5). This limit is that for the core wire of the core strand for axially symmetric cable, and that for wires of the inner armor wrap for contrahelical cable.

Note: In both stress regions, fatigue rate is much higher for steel cable than titanium. This use of stress regions illustrates the much heavier work load which can be carried in the lower stress region of a ti cable, compared to the same strength steel cable, and thus low grade fatigue control is also maintained as with conventional load control for steel cable tension systems. It also illustrates how the cable of a ti materials handling system would not be fractured due to high initial velocity (Vo) value of impact stresses ($\sigma i$) and counterbalancing (dissipating) action in the ti cable of this invention.

(e) Stress intensity (Klc) in this case is measured under the condition of plane strain, the maximum possible mechanical constraint that can be applied to the wire so that Klc will represent the lowest value of fracture-toughness at the wire fracture stress level. Common cable stress risers are changed and passively controlled in novel ways in titanium cable of this invention. Kc, the fracture resistance parameter can be calculated by measuring the stress acting upon a crack just prior to instability. A relationship exists between crack growth and fracture resistance.

(f) Cable efficiency is the percentage obtained from the cable breaking strength divided by the total tensile strength (lbs) of the wires in the cable assembly.

(g) Linear is a term applied to characterize the deflection of a tension member, normally either wire or cable, under load to the elastic limit. Steel wire is known to become nonlinear (curvalinear) under load ($\sigma$) and strain well before reaching the elastic limit as shown in typical load deflection diagrams whereas titanium wire is found to be particularly linear.

(h) Cable load deflection is stretching of wire and cable under load, and is defined by the pattern of the load diagram obtained from a tensile testing machine normally having the capacity to fracture the members tested by applying gradually increasing tension.

The following comparison of dynamic factors amplifies the understanding of the foregoing definitions.

(a) Bend stress ($\sigma b = E_W(\delta/D)$) may become sufficiently severe at small diameter ratios, as a function of the ratio between wire size and sheave diam. when bending in sheaves and on drums, so as to cause plastic flow, and in turn prevents relative wire movement internally within cables. Thus the lower titanium modulii are most effective attributes in performing work.

(b) Surface contact stress ($\sigma c = 4580\sqrt{\rho}$) is known to cause rapid fatigue in steel cable because of the large pressure constant whereby it is reduced to approximately 2050 for ti cable (depending upon the base alloy) as functions of tension and elasticity.

(c) Titanium cable inertial tension ($Ti - To) = VoX\text{-}A\sqrt{E_c X \rho_c}$) is, again, about one-half that of steel cable wherein tension peaks can not build to high levels due to the high spring constant as accentuated by use of novel cable construction features. Comparison of these factors in steel and titanium, while somewhat variable in each of these materials, are tabulated in representative numbers:

1. Density—Steel=0.29# per cu. in. Ti=0.16# per cu. in.

Note: Density is substantially reduced in cable structures as denoted by the values of mass density (due to vacancies).

2. Modulus of Elasticity (E) Steel=$29\times10^6$ p.s.i.

Ti=$15\times10^6$ p.s.i.

$E_c$ (cable) Steel $24\times10^6$ p.s.i. Ti=$12\times10^6$ p.s.i.

Note: $E_c$ is a false modulus created by constructional stretch of cable.

3. The dynamic (contact) constant in the formula for low carbon steel surface contact stress ($\sigma c$) is well moderated by ti base alloys as noted in subpar (b) above.

4. Inertial tension $(Ti - To) = Vo \times A\sqrt{E_c x \rho_c}$ where To and Vo are static tension in pounds and initial velocity in ft./sec. respectively. For dynamic states of tension members, the following symbols are used herein: (a) $\sigma$b, $\sigma$c, $\sigma$i, is stress in lbs. per sq. in. for bend, surface contact, and impact respectively. (b) Ec and Ew is elastic modulus for cable and wire. (c) $\rho$c is cable mass density. (d)$c = \sqrt{\sigma/E}$ is speed of axial stress propagation in ft/sec. Transverse speed of stress propagation $\bar{c} = \sqrt{\sigma/\rho}$ wherein initial stress ($\sigma$) is thus found by $(\sigma/Ec) = \frac{1}{2}(Vo/c)4/3$. (e) $\sigma b = E_w(\delta/D)$ is bend stress in lbs. per sq. in. (f) $\sigma i = Vo\sqrt{Ec\rho_c}$ (g) $\delta$ is wire size and D is sheave/drum diameter.

It may now be noted that elastic modulus (E) affects all dynamic stresses, mass affects two, wire size affects one (bend stress), and initial velocity affects one (impact stress).

The stress and fatigue control concept of this invention derives from two (2) discoveries about dynamic characteristics of titanium cable compared to steel cable as illustrated in FIGS. 1 and 2. The first discovery is contrary to the findings of previous investigators that tensile strength of structural forms is the dominant property for sustaining loads. While this accepted finding appears to have logic for static strength members, this finding is indeed inadequate and not logical for use with tension systems when performing work. Nor is the old cable practice of strength combined with flexibility adequate when dynamic analysis and physical phenomena are applied. This discovery rather requires a special combination of mechanical, physical and dynamic properties and constructions that are suitable for absorbing, storing and dissipating energy while performing work, this being dominantly a dynamic concept, rather than dominantly a massive concept accompanied by high tensile strength and large safety factors which has long prevailed.

The first discovery showed (FIG. 1) that for the same tensile strength, the hyperbolic load characteristic of ti cable in terms of cycle life, with primary load as a percentage of the breaking strength, was much greater than sustained by carbon steel cable. Remarkably also, at the upper limit of the lower stress region (primary load 21%), had a relative flat cycle life and high endurance, even though wire process variables had not yet been effectively established for titanium wire. Steel cable only sustained a 6 to 7 percent primary load for a shorter endurance period, this work performance load being about one-third of titanium cable.

The second dynamic discovery showed the vital flexibility characteristic required for cable handling in performing work, to induce about one-half of the bend stress calculated for steel, as confirmed in cycle testing, FIG. 2. At low-loading, bend stress effects completely disappeared in 7×19 ti cable (133 wires), and virtually disappeared in 7×7 titanium cable (49 wires), at D/d ratios of 25 to 30, FIG. 2, whereas established ratios of these same steel constructions (shown in handbooks) are at least doubled. It should be noted d represents cable diameter in this case, not wire diameter. Thus the flat parabolic bend characteristic shows this dynamic stress to be effectively limited in terms of fatigue rate. This discovery is also remarkable because the dynamic gain in flexibility, technically shows elastic and frictional stiffness, internally, are also both further reduced through greater elastic compliance and lower internal stresses because of fewer wires in the work cable. The stiffness gain and other attributes avoids plastic flow at wire crosspoints that create intense local stresses. Moreover handling rates may be increased, particularly in materials handling systems.

The steel stiffness characteristic, as a problem in cable handling, converts into an effective spring characteristic in ti cable, as to be discussed, which also avoids cable kinking and "bird-caging" when stiffness changes to springiness.

A further stress and fatigue attribute is the low gap between yield and ultimate strengths of titanium structural wire, in two (2) alloys, which ranges between 2% and 12% wherein yield strengths are between 88% and 98% of ultimate. This smaller gap in metallic structural wire produces high hard spring. To correlate further, the hexagonal close packed (h.c.p.) titanium base alloys are in the lower part of this range while the all-beta alloys are in the upper part. Specially processed wire then guarantees that this range will indeed be narrow, and that this hard spring may be converted into cable soft spring by using short lay lengths and high preform in construction specifications. The soft spring illustration, FIG. 4, shows this inherent counterbalancing action reduces axial impact stresses, and low order axial and transverse wide amplitude stress vibration further relieves internal stresses.

A further discovery, found in making cable load deflection diagrams, is that to these dynamic gains, added also in an important mechanical attribute. Cable efficiency, i.e., cable breaking strength divided by the total breaking strength of each cable wire, is increased. In ¼" 7×19 cable this percentage is about 92% while in ¼" 7×7 cable it increases to about 94%, when wire processing variables are well established; this is a gain of about 10% over many steel cables.

By analysis of titanium work performing cable, these dynamic attributes now show:

(1) Classical hyperbolic fatigue effects from a range of primary loads in the lower stress region are much less marked in ti cable than the same effects in non-linear steel;

(2) Classical parabolic fatigue effects of bend stresses produce a well flattened curve from a median range of D/d ratios, whereas the same D/d ratios rapidly fatigue a steel work performing cable;

(3) Impact stresses are suppressed by a combination of low modulii and low mass density to effectively absorb and store work energy while the high soft spring constant counterbalances against the impacts of axial dynamic stresses;

(4) Stress vibration is effectively moderated by high soft spring;

(5) Internal stresses are moderated by elastic compliance to avoid severe local stresses while performing work. These two (2) classical fatigue effects operating simultaneously in concert show that a uniquely high level of work may be performed throughout protracted service life of the tension system, while it works in a passively controlled stress condition even though the shock environment may be severe.

By examining the hyperbolic and parabolic effects, shown on FIGS. 1 and 2, the tensile strength and massive approach is, in fact, slightly superior only at extremely small D/d ratios which, in effect, is destructive in a very short cycling period to all cables which is of no consequence whatever in terms of serviceability. However, as the dynamic attributes of titanium are felt, superiority quickly shifts and grows to show the decided effects and advantages of the dynamic approach to performing work effectively. The cable structural form, clearly, dominantly requires suitable flexibility and dynamic properties for performing work.

For convenience, the legends for the figs. are:

FIG. 1

- Curve "A"—Load curve for first ¼" 7×19 Ti-6Al-4V cable
- Curve "B"—Load curve for second ¼" 7×19 Ti-6Al-4V cable
- Curve "C"—Load curve for stainless steel ¼" 7×19 cable
- Line D"D"—max. stress level for first ¼" 7×19 Ti-6Al-4V cable
- Coordinate E—Cycle life of non lubricated Ti-4Al-4V cable

FIG. 2

- Steel Pressure Curve A (handbook) $X^2=2$ py for 6×25 cable
- Curve B—¼" 7×19 stainless steel cable
- Curve C—¼" 7×19 Ti 13V-l Cr-3Al cable
- D—¼" 7×7 Ti-6Al-4V cable

FIG. 3

- (a) Enlarged core ⅓ strength, axially symmetric construction; Core and outer strands with opposite lays
- (b) Enlarged core ⅓ strength, contrahelical wraps; Core and inner strand with same lay
- (c) Enlarged core ½ strength with single opposite outer wrap

FIG. 4

- Illustration of steel and titanium spring amplitudes showing difference in shock amplitudes for dissipating energy.

By further elementary analysis, combined with a data example of a work performing cable, stress and fatigue control should now be understood:

(a) Elementary stresses in work performing cable of materials handling systems are: (1) tension due to primary and dynamic loads, and (2) tension due to bending or wrapping around drums and sheaves. These dynamic loads include impact stresses, surface contact stresses, internal stresses and wire pressure, as earlier defined by formulae, and these stresses may be calculated as noted above.

(b) According to Hertzian contact theory, initial stress ($\sigma_h$) is expressed by the formula $$\sigma h = \frac{KT - 1/3}{\left(\frac{1 - \upsilon}{Ec}\right)}$$

or nominal compressive stress (p.s.i.), where K is the constant of proportionality, $\upsilon$ is Poisson's ratio, and T is tension or cable load, in lbs. In performing work, the surface contact stress ($\sigma c$) is normally the dominant stress due to wire pressure caused by work load while bend stresses may also be high.

Thus, bend stresses ($\sigma b$) superimposed upon surface contact stresses will cause wire fractures in the bend region; with impact stresses ($\sigma i$) also imposed, this stress accumulation in steel cable causes rapid fatigue in the high stress region, and wire fractures near the point of impact.

(c) Then assume for example, a 1" 6×37 steel wire rope (highly flexible and having a breaking strength of 50 tons), is under relatively low bearing pressure of 200 p.s.i., carrying a 10 ton load, when characteristic stresses are:

Surface contact ($\sigma c$) = 45,000 p.s.i.

$$\text{Bend } (\sigma b) = \frac{(30 \times 10^6 \times .6) \times .055''}{24} = 41{,}000 \text{ p.s.i.}$$

$$\text{Impact } (\sigma i) = 50 \times (30 \times 10^6 \times .6) \times .29 \times 65 = 30{,}000 \text{ p.s.i.}$$

(where $Vo$ = 560 ft. per sec)

Note: bearing pressure (200 p.s.i.) selected is very low for 1/5 of the breaking strength, and ultimate stress is 100,000 p.s.i. Significantly at this loading (1/5), parts of the wire rope would overstress and rapid fatigue would occur if work was performed in a low shock environment without severe impacts; however this environment is not realistic. Impact stresses normally can not be avoided when the load is applied, or handling quickly stopped. In fact sudden impact resulting in a distinct change of velocity (Vo) should cause successive fractures of cable parts under this loading.

(d) Because of such tension member stressing, large safety factors are common and must be used for steel cable such as 4 to 7 for hoists and cranes, 4 to 8 for mine shafts and 8 to 12 for elevators depending on risk. On the other hand, had this been a 1" 6×37 titanium cable, also with a ten (10) ton load, the same stresses would approximate:

| | | | |
|---|---|---|---|
| 1) | Wire pressure | 100 p.s.i. | |
| 2) | Contact (pc) | 19,500 p.s.i. | |
| 3) | Bend (σb) | 18,000 p.s.i. | |
| 4) | Impact (σi) | 13,000 p.s.i. | (Vo = 50 ft/sec. |
| | total: | 50,500 p.s.i. | |

This titanium accumulation is less than one-half steel cable stressing.

(e) 1" 6×37 titanium cable would thus operate at the top of the lower stress region (primary load—10 tons) except for occasional impacts of starting and stopping. While fatigue would occur, perhaps only in the core strand, it should have a long service life because of aforementioned attributes including counterbalancing. At a lower load of eight (8) tons, or a larger titaniun cable, 1 1/16" diam. a protracted service life would result. Thus, stress and fatigue may be passively controlled but also in addition, other novel control techniques are used in this invention.

Noteworthy is the complex steel cable construction required 222 wires, to have flexibility, and a normal factor of safety. This number is also essential to avoid severe bend stresses.

(f) Again based upon Hertz contact theory, the pressure relationship between steel and titanium is confirmed by formula derived from this theory:

$$\text{(titanium)}\left(\frac{1-v^2}{Ew(ti)}\right)$$

$$\text{(steel)} = \left(\frac{1-v^2}{Ew(\text{steel})}\right)$$

where the elastic constant for titanium is $14.5\times10^6$ p.s.i., and for steel $29\times10^6$ p.s.i. Poisson's ratio is somewhat greater than 0.3 for both materials and only slightly more for titanium than for steel.

Then $(\sigma ti/\sigma St)=(\sim)\ 4\frac{3}{8}$, or about 0.5; i.e. contact stress for titanium is initially one-half the value of the same steel stress under an equal cable load with elastic compliance (E) being the dominant factor in distributing contact stress. Also the initial ratio of stress would decrease with enlargement of contact areas. In practice, this would occur through using larger titanium wires due to their greater flexibility and spring, and their non strain and work hardening property.

The novel features that are considered characteristic in work performance and reliable service of this invention are set forth with particularity in the appended claims. The invention itself however, both as to organization and method of operation, as well as additional objects and advantages will be best understood from the following description.

It is now well understood that mechanical, physical and dynamic properties of steel and titanium are distinctly different, titanium also being a reactive type metal; and thus, work performance characteristics of titanium cable, as aforementioned and other attributes, cause these titanium characteristics to indeed be superior. The superiority of this invention however, includes characteristics of fatigue strength, fracture toughness, stress control, counterbalancing, wear, safety factor, cable handling and service life.

It should be further understood that titanium monofilament, as a structure, is likewise superior in limited applications, but most tension systems obviously require flexibility for handling while performing work, as well as freedom form "kinking" and "bird caging," two (2) weaknesses of steel cable, wherein monofilament is limited.

This understanding should also include that performing work embodies continuous absorbing, storing and dissipating energy, wherein steel cable weakness is in passive dynamic energy control. It includes further that these several titanium attributes permit the use of novel design and construction criteria which advance energy absorption and dissipation, to be specified hereinafter.

It should be recognized that the superiority of steel's greater tensile strength even though the old manners of imposing a load limitation of one-fifth (1/5) the ultimate tensile strength is indeed a drastic limitation not required by titanium cable. Within this commonly used steel lower stress region, it is then logical that titanium cable should demonstrate remarkable superiority. A work performing test program was then conducted centered upon the stress and fatigue control concept of this invention hereinafter described.

In accordance with the present invention, two (2) titanium structural wires were specially processed, following the process described in U.S. Pat. No. 3,511,719, one wire was fabricated from Ti-6al-4V having an h.c.p. microstructure (alpha-beta), and the other a Ti-13V-11Cr-3al wire, b.c.c. microstructure (all-beta). In both cases, structural wires were drawn down to the following wire sizes, 0.0215", 0.020", 0.0185" and 0.017". Two (2) ¼" 7×19 titanium cables were assembled from these wire sizes. It was necessary to vacuum anneal the Ti-6al-4V wire more frequently in the reduction process, and necessary to heat treat Ti-13V-11Cr-3al to obtain maximum tensile strength. Both wires were highly ductile and their average strengths were 205 K.P.S.I. (Ti-6al-4V) and 240–250 K.P.S.I. (Ti-13V-11Cr-3al) respectively. While strengths of 275–285 p.s.i. were obtained by heat treating Ti-13V-11Cr-3al, equivalent to some high carbon steel wire, the wire became brittle and lacked fatigue strength. These were discarded. In the wire structural form, Ti-6al-4V, after process variables were determined, proved to have uniquely uniform properties in tensile strength, torsional strength, gap between yield and ultimate strengths, and coiled spring characteristics of amplitude and frequency. Torsional strength of Ti-6al-4V wire was high, being about 6/7 that of high carbon steel wire while density was only 0.55 as great. At the same time, mechanical testing of mildly heat treated Ti-13V-11Cr-3al did not prove to be as uniform in the same tests including low values in torsional testing, thus indicating fatigue strength, impact strength and fracture toughness of heat treated Ti-13V-11Cr-3al wire was inferior to Ti-6al-4V wire.

Cable testing followed, in phases, to demonstrate the degree to which it was possible to:

(1) obtain uniform results in cycle testing under load (work performance)

(2) ¼" 7×19 and 7×7 cables were used, and the test machine, for practical purposes, conformed to the test requirements specified for carbon steel cable (Mil-W-1511A) and corrosion resisting steel cable (Mil-C-5424A) specified for aircraft control cable.

Phase I.

The first cable specimen constructed—Ti-6al-4V, had a relatively wide range of breaking strengths averaging 3750 lbs. and load cycling data as tabulated:

| | | | |
|---|---|---|---|
| Load Cycles | 1/5 (20–21%)-800 lbs 300 to 450,000 cycles (900,000 reversals) | 1/4(25%)-1000 lbs 110,000 cycles (220,000 reversals) | 1/3(33%) 1200 lbs 40,000 cycles (80,000 reversals) 1/2(50%)-1900 lbs 10,000 cycles (20,000 reversals) |

Notes:
1. Continuous oil lubrication was used
2. D/d ratio = 25.
3. Internal wire wear occurred at 1/3 and 1/2 loads, but no fractures occurred in outer strands.
4. At no lubrication and 1/16 load, cycle endurance was 100,000, thus showing the importance of lubrication.

Test summary—Process variables had not been fully determined for reducing coiled rod stock to fine wire and cable construction specifications remained identical to plough steel wire. It was then found endurance of titanium cable was superior to both carbon and corrosion resistant steels, according to the above mentioned mil-specs in the high stress region, and titanium cable could be loaded to much higher proportionate stress level. The importance of lubrication for reducing internal friction to substantially increase endurance was established. It became clear due to substantial wear of core wires where the greatest were occurred that (a) cables with fewer wires, now feasible because lower elastic modulus (E), and (b) reduced internal friction, would result in major endurance gains as a trade off with bend stresses. Improved process variables were clearly necessary to optimize endurance, and maximize fatigue control, the major objective of the invention. The arbitrary D/d of 25 in the rigging of the machine is 5/9 of the conventional ratio (45) for 6×19 cable to represent a vital parabolic working gain for systems such as materials handling systems and those with small aircraft pulleys.

Phase II.

A ¼" 7×19 aircraft control cable assembled from mildly heat treated Ti-13V-11Cr-3al wire, having the same wire sizes, was cycled according to the above mentioned Mil-Specs. Three (3) tensile test specimens had an average strength of 6400, with low tensile variation within ±25 lbs, thus representing excellent property homogeneity. In the low stress region specified, single wire fractures began to occur at 850,000 cycles (1.7 million reversals) while cycling at a D/d ratio of 30. The lower stress region was used to determine (1) fatigue effects, (2) surface contact wear in pulley grooves over a long cycling period, (3) bend and impact effects from a large number of cycles, (4) effectiveness of solid film lubricant, and (5) feasibility of using more brittle titanium alloy (all-beta) wire which was drawn using greater reduction in areas than alpha-beta alloys, thus at less cost.

Test summary—Three (3) remarkable findings were made; (1) endurance in the low stress region of this magnitude was not expected of a brittle alloy; (2) solid film lubricant neutralized wear under these test conditions; and (3) abrasion of wire crowns was essentially suppressed (see file Ser. No. 707,951). Clearly more data was now needed under a range of D/d ratios with cable wires coated with thin solid film lubricant. The magnitude of endurance gains with solid film lubricant, showed excellent fatigue control in the lower stress region. In addition, a ten (10) to twenty (20) percent strength gain in Ti-13V-11Cr-3al to a homogeneous level of 240–250 K.P.S.I. was made using mild treatment to age the alloy.

Phase III.

A ¼" 7×7 Ti-6al-4V cable was then tested because of its (1) greater fracture toughness and impact strength than Ti-13V-11Cr-3al, and (2) fewer wires, 49 (compared to 133) to (a) reduce internal stresses and wire wear, (b) to reduce excessive flexibility, and (c) a greater soft spring constant for increasing counterbalancing (energy dissipation). Nevertheless, the same D/d ratio (30) was used. The four (4) wire sizes were increased to (1) core wire, core strand—0.032", (2) outer core wires —0.0305," (3) outer core wires—0.0285", and (4) outer wires, 0.027". All wire was coated with solid film lubricant. Starting material was Ti-6al-4V rod stock with ELI (extra low interstitials) which produced remarkable homogeneity in tensile strength and torsional strength while 3 cable tensile specimen averaged 5300±15 lbs wherein wire breaking strength averaged 200 PSI, ±5 lbs. thus representing reaching a homogeneous level of process control. The first cycle test specimen reached 956,833 cycles (1,813,666 reversals) with no wire fractures when the machine failed, having sustained very limited wear on outer wire crowns and no measurable wear on inner wires. A second specimen then sustained 1,560,000 cycles (and 3,120,000 reversals) also with limited crown wear and no internal wear. Microscopic examination of wire surfaces showed the thin solid film had worn generally but a good part of it was found impacted when magnified in the microscopic sized valleys.

Test summary—it was found that (a) a remarkable improvement in endurance results to show that passive stress and fatigue control is a practical technique, (b) solid film lubricant is effective in neutralizing wear in lower stress regions, (c) 49 titanium wires were substituted for 133 steel wires (carbon and corrosion resistant) in the strength range between 5300 and 6400, while improving materials handling, (d) frictional and elastic stiffness was much improved, and (e) an effective spring constant was added for counterbalancing dynamic stress. This last test required two (2) months, an unduly long time.

Phase IV.

Cycling carbon and corrosion resisting steel cable, for comparison to titanium cable using the same machine and test parameters, causes much greater fatique (FIGS. 1 & 2) induced from bend stresses over a range of D/d ratios, impact stresses over a range of load changes, and internal stresses and surface contact stresses ($\sigma c$) within these changes. Results from load changes and surface contact stresses plot in a hyperbolic curve. Changes in bend stresses plot in a parabolic curve, showing the severe effects of these stresses and the need to passively control them. These two curves are then established by using the variable bend stresses in one case and impact stresses as affected by loading in the other case. Of course, surface contact stresses (c) and wire pressure are indeed present to add to the accumulation of all dynamic stresses. It should be noted in the comparison (FIGS. 1 & 2) however, the steel stress "load" plots from (hyperbolic curve) 300 lbs (8% breaking strength) to 800 lbs (21% breaking strength), and "bend" plots (at 100 lbs) from D/d−5 to D/d=30 (parabolic plots) have these effects:

TITANIUM—loading has very little fatigue effect below 1000 lbs at an ultimate strength of 5300 lbs (or 20%) throughout the lower stress region.

Bend stresses have very little fatigue effect at this same strength at a D/d ratio of 25 or greater throughout the lower stress region. Effects completely disappear at a D/d ratio of 30 and a load of 100 lbs in both constructions.

STEEL—Loading has a progressive fatiguing effect at an ultimate strength of 6250 lbs and in 7×7 construction throughout the lower stress region becoming decidedly curvalinear at 500 lbs loading resulting in a short cycle life at 1000 lbs.

Bend stresses have a marked fatiguing effect at D/d ratios between 15 and 40, at the same strength and in the same construction.

Wire crowns in corrosion resisting steel become severely abraided in service, and in comparative cycling, contributed to early failure at low loading. Abrasion of carbon steel is also severe but the rate is somewhat slower.

On the other hand, it should be noted that the 900 lb loading of the titanium cable, i.e., 1.8 times greater loading, continued to 925,000 cycles (1,850,000 impacts). The combination of impact strength, fracture-toughness, high dynamic properties and spring constant, and solid film coating with high abrasion resistance, produced remarkable results; but some test quantities at these remarkably low fatigue rates remain indeterminant because of the extended test period required to obtain specific values within this remarkably stable flaw state.

A ⅜" 7×7 Ti-b 13V-11Cr-3 al titanium cable has been constructed having an average breaking strength of about 13,000 lbs. since the test program was completed. A carbon steel ⅜" 7×7 cable has approximately the same breaking strength, stainless (12,000 lbs) and for the purpose of the following calculations, this was assumed to be the case. A very low bearing pressure of 25 lbs was selected for the steel cable, so that the surface contact stress ($\sigma c$)=4580$\sqrt{25}$=22,900 p.s.i. Additional theoretical dynamic stresses are:

$$\text{Bend stress } (\sigma b) = Ec\frac{\sigma}{d} \times \frac{d}{D} = 24{,}000 \text{ p.s.i.}$$

$$\text{Impact stress } (\sigma i) = Vo\sqrt{Ec \times \rho_c} = 20 \text{ ft/sec } 12 \times 10^6 \text{ p.s.i.} \times .05 = 12{,}000 \text{ p.s.i.}$$

(where Vo=20 ft/sec, Ec12×$10^6$ p.s.i., $\sigma_c$=.05 lbs per cu in.)

Total dynamic stress load=58,900 p.s.i. or 6500#for ⅜"diam. Compared to titanium stresses:

$$\text{Surface contact stress } (\sigma c) = 2050\sqrt{25} = 10{,}250 \text{ p.s.i.}$$

$$\text{Bend stress } (\sigma b) = \frac{2.4M = .048''}{24} = 9{,}600 \text{ p.s.i.}$$

$$\text{Impact stress } (\sigma i) = 20\,(5 \times 10^6) \times .016'' = 5000 \text{ p.s.i.}$$

Total dynamic stress load=25,650 p.s.i. or 2,820 lbs.

Steel dynamic stresses 6500 lbs or 54% of 12,000 lbs, this being in the upper stress region wherein core wires would be overstressed and rapid fatigue and wire fractures are incurred. Titanium dynamic stresses are 23.5% of breaking strength, and together with the primary load, is also in the upper stress region (lower part) but no wires are overstressed, the fatigue rate is slow, and work performance is high in a shock environment.

This mathematical comparison does not include stress vibration and internal stresses, added fatigue factors, nor does it provide values for marked counterbalancing action in the titanium cable. The principal advantages in the stress patterns are the cable modulii of elasticity, lower mass density and the high hard spring in the wire and soft spring in the cable (due to high preform angles and shortened lay lengths used in stranding and closing the cable) as these attributes convert into graphically flat controlled hyperbolic and parabolic dynamic conditions while performing work. In this stress condition the ⅜" 7×7 Ti-13V-11Cr-3Al cable will operate well within the flat parts of both the above mentioned curves to result in effective and passive stress and fatigue control.

In addition to these dynamic attributes of titanium, it is now apparent that two (2) titanium wire characters have been improved in processing, and more suitable titanium lay lengths and preform have been used in cable construction, tested and reduced to practice. Within this work, a new cable characteristic, counterbalancing action has been distinctly embodied, wherein the capacity for energy control has been passively increased in magnitude so that this added characteristic may be associated with the hard wire spring constant for use in work performing tension members. Moreover this characteristic effectively contributes to improved reel handling while preventing "kinks" and "bird cages."

Stress and fatigue factors in cable tension members are now described and briefly evaluated using titanium data in relation to steel cable:

(a) The dynamic stresses identified herein (bend stress ($\sigma$b), impact stresses ($\sigma$i), surface contact stress ($\sigma$c), and wire pressure (p), and stress vibration that propagates axially and transversely, have been related to fatigue, and only to a limited extent, fracture processes, when performing work in such a way as to moderate stresses, control fatigue and extend cable service life.

(b) Each of these characteristic stresses has been shown to contribute to fatigue in tension members wherein the relative dynamic stress value of titanium stresses is about two-fifths to one-half steel stresses in identical shock environments. At the same time titanium stresses are moderated, and dynamic energy is dissipated more rapidly due to the high cable spring constant, transformed into a counterbalancing characteristic, the high hard spring constant being a function of the low gap between yield and ultimate strengths of titanium base alloy wire.

(c) In both the lower and upper stress regions, a much greater amount of work is performed by titanium cable while fatigue is controlled in terms of higher loads and longer service life. It has also been shown that lower dynamic factors of safety can now be used due to passive control of dynamic stresses in shock environments and the counterbalancing effect for dissipating energy.

(d) Since wire fracture has been a primary failure mode in work performing cable, two (2) additional fracture-tough characteristics of titanium base alloys, contribute to fatigue control as shown in government data (DMIC reports), as noted: (1) a sharp transition to reduced fracture-toughness does not occur at temperatures well above room temperatures; and (2) a brittle transition does not occur with temperature reduction as in ferritic materials. Thus titanium is likewise suitable for use in aerospace and oceanographic applications.

(e) Strain-hardening of titanium microstructures under stress including stress vibration is a very slow metallurgical process, also shown in government data and as previously outlined, so that fatigue from this cause is correspondingly slow.

(f) Plastic flow, as commonly found in steel cable at wire cross over points of bending regions due to severe cumulation of bend stresses, wire pressure and internal friction, does not occur in titanium, possibly due to lower dynamic stresses specifically including lower wire pressure but normal wear continues at these points.

(g) Abrasion resistance of titanium metal is the second highest of all metals (chromium is highest), while steels are about fifth and sixth, as was shown in cycle tests described.

Thus, the physical and dynamic factors which severely limit the fatigue strength and life of steel wire and cable, are well moderated, or are not characteristic of titanium wire and cable, so that stress and fatigue control becomes practical in both axially symmetric and contrahelically wrapped titanium cable. In effect this control changes the flaw state of these structures wherein characteristic flaws either disappear or their crucial nature is relieved so as to produce protracted service.

The attributes of titanium and the test data included in this specification, as compared with steel wire and cable, provide for the use of new and improved cable design criteria in the development of effective titanium tension systems as analyzed herewith:

(1) Advances in design principles and criteria have been made so as to increase their scope.

(2) Titanium cable of equal strength to steel cable sustains an increased work load while cycling at longer life in the lower stress region as shown in FIG. 1.

(3) Successful substitution of ¼" 7×7 titanium cable for a 7×19 steel cable at the same D/d ratio (30), while tripling cycle life, shows how fatigue control may be exercised. D/d ratios of 30 for 7×7 titanium cable, with a metal core, a stiff construction by steel standards, may be effectively used due to lower elastic and lower frictional stiffness, and now permits optional design trade offs within work cable parameters.

(4) High abrasion resistance of titanium wire, confirmed in protracted cable cycling under an impact load environment, contributes to the stress and fatigue control concept, and insures concurrent control of the wear phenomenon.

Foregoing test highlights illustrate wide trade off latitude in optimizing parameters for titanium work performance cable in utilizing its dynamic and physical attributes.

By further analysis, results of the test program contradict and upset the long standing conclusion of previous Investigators, that tensile strength and massiveness are dominant requisites. This test program, shows that the cable specimen or structure must be primarily suited to the absorption, storage and dissipation of energy in shock environments, wherein the element of strength is only one of many other structural and dynamic elements required. For example it has been shown other essential elements are high elasticity, good flexibility, elastic and constructional stretch, high soft spring and low mass density; when combined with effective design principles and criteria, each of these elements has been shown to contribute to stress and fatigue control.

These novel findings from the test program also upset the brute strength approach used in steel cable constructions wherein the safety factor is presumed, in the old manners, to be adequate to provide ample breaking strength quite irrespective of dynamic conditions. This presumption does not provide against rapid fatigue in steel flaw states due to high accumulation of dynamic stresses and the problems of stiffness in work environments; serious problems derive from the brute strength approach.

Based upon data herein, other handbook data and analysis, non ferrous al wire and cable, with high dynamic properties in all non-frangible alloys, is a practical substitute in many applications for ti wire and cable. Some new alloys have been increased in tensile strength so that strength-density ratios exceed those of ti base alloys. A test program has not been carried out but interesting discoveries are expected as in the ti program.

It should now be understood that the cable cycling process, as used for the test program, may be effectively used to establish basic stress and fatigue characteristics which should embody all cable work parameters (not including wire) when combined with cable dynamics formulae. Work performance parameters have been effectively established to control flaw states and specifically include: (1) loading, (2) D/d ratio limits to control bend stress, and (3) Hertzian surface contact stress control between wires, cable and handling components. At the same time wear and abrasion effects may be determined. Hyperbolic load, and parabolic bend data are vital to work performing tension systems, as dynamic, work performance data, and should be combined with mechanical and physical wire data, to establish effective design parameters and principles.

Further, mathematical and test analysis show the attributes of titanium wire, that is both wire characters (h.c.p. alpha-beta and b.c.c. all beta) are selectively suitable for axially symmetric and contrahelically wrapped, work performing titanium cable. These attributes are essential to the stress and fatigue control concept which must embody: (1) low wire and cable modulli (Ec) and low mass density ($\sigma c$) to absorb and store energy, (2) high wire hard spring and high cable soft spring to provide a marked counterbalancing action in dissipating energy while suppressing dynamic stresses, (3) low elastic and frictional resistance (low modulus and fewer wires) in cable handling, (4) wide amplitude and low frequency stress vibration (5) stress transfer and equalization between cable layers to avoid tension peaks and local stress risers, and (6) layer slippage and low order impacts under stress vibration (wire deformation not found as in steel wire); layer slippage has been observed under stress vibration against cable pressure.

It should now be further understood that combining titanium attributes embodied in wire and cable with design principles and criteria as outlined above, have produced three (3) basic changes as advances over old steel cable construction manners:

1. Conventional core size of axially symmetric cable may be substantially and effectively increased in size and capacity to initially sustain the full load, both primary and dynamic, to avoid overstressing or danger of catastrophic fracture (see FIGS. 1 & 2). This design change has three (3) advantages:

(a) Characteristic core fatigue, and wire fractures within the core, are avoided wherein wire pressure is also reduced.

(b) High tension peaks in the outer strands are avoided through stress stratification and rapid stress distribution in the axial and transverse stress propagation process.

(c) Maximum counterbalancing action is induced and permitted in the outer strands due to low loading and mild dynamic stresses in short helical lay lengths.

The core cross section needs to be greater than one-fourth (¼) the total area since primary loads are not greater than one-fifth (1/5) of the cable breaking strength as has been shown (FIG. 3*a*) in stress calculations and the test program. In turn, this basic construction concept permits wire sizes to be equalized so that wire bend stresses are likewise equalized, and contribute to stress and fatigue control. Core cross section may be allowed to grow to one-half (½) the total area without unduly distorting axially symmetric geometry, due to high dynamic properties.

2. Structural and electrical construction of contrahelically wrapped cable, as shown in FIG. 3*b*, embodies an axially helical core while the outer wrap may have greater or less constructional and vibratory stretch due to designed helical lay length control, this stretch being also functionally dependent upon the core modulus of elasticity (Ec). Electrical core materials, aluminum and copper having greater elastic stretch (Ew—$10-12\times10^6$ p.s.i.) than titanium, are effectively combined in cores at structural and equivalent wire sizes in dynamic and shock environments to serviceably perform both mechanical and electric work simultaneously. 3. The enlarged core, using one lay (for example right hand) is combined with a single helical wrap in the opposite lay (left hand) wherein the core area is as much as one-half (½) the cross section, (1) wire sizes in the core and the outer wrap are approximately equal so that bend stresses are equivalent, and (2) the linear rotational characteristic is well neutralized by the advantages of low elastic modulus, high hard spring, low mass density, and non-torsional design criteria. This change can obviously eliminate the need for one outerwrap, so as to embody major structural dynamic, and handling advances, and more specifically reduces cable diameter and torsional forces.

It should be further understood that both axially symmetric and contrahelically wrapped work performing cable can now have an effective composite materials structure within the cross section with basically increased design latitude. When a second material is used, however, due regard must be had for the dynamic and mechanical properties of the second material which specifically and suitably includes aluminum, copper, steel and synthetic fibers.

It has now been disclosed that two (2) titanium wire characters have been used in the embodiment and construction of three (3) axially symmetric, work performing cables used in a test program which, by analysis, has determined:

(a) the superior performance of titanium over steel cable;

(b) the relative effectiveness of two (2) titanium wire characters in performing work;

(c) the general but wide limits stress and fatigue control can be applied in work performing tension members;

(d) the effectiveness of the association of three (3) physical phenomena (fatigue, fracture toughness, and wear) in achieving stress and fatigue control to result in protracted service life of tension systems;

(e) by analysis of properties, formulae and test data:

1. design principles and criteria have been changed, expanded and advanced in tension systems to suit and accommodate physical, mechanical and dynamic properties to perform work more effectively;

2. core designs have been enlarged in axially symmetric and contrahelically wrapped cables to increase work accomplished and cable efficiency;

(f) the tensile strength and massive approach has been replaced by an energy absorption, storage and dissipation system in performing work with tension systems through stress and fatigue control at low stress levels;

(g) Elastic and frictional resistance is reduced by using titanium wire in cable cross sections and reducing the number of wires.

It has been further disclosed that the dominance of tensile strength is not effective for performing work by tension systems of the old manners, which has been replaced by a new system effective in performing work by absorbing, storing and dissipating energy wherein passive control is characteristic of stress levels and fatigue rates. Also, flexibility may be controlled by virtue of doubled elasticity and the number of wires used in the cable construction so that lower D/d ratios are used and lower external stresses are induced. New materials including aluminum, new processes and new design principles are used in cable tension members, including composite materials based upon two different titanium wire characters for exploiting its hard spring characteristic and several other attributes.

The invention and its attendant advantages will be understood from the foregoing description and it will be apparent that various changes may be made in the form, construction and arrangement of the parts of the invention without departing from the spirit and scope thereof without sacrificing its material advantages, the arrangement hereinbefore described being by way of example and I do not wish to be restricted to the specific form described, or uses mentioned, except as defined in the accompanying claims, wherein various portions have been separated for clarity of reading and not for emphasis.

What is claimed is:

1. A cable made of a plurality of titanium (ti) wires having an elastic modulus of about $12\times10^6$ psi, and a spring constant inversely proportional to said modulus, being stranded and layered in helices, said cable having high capacity for work at maximum loads in helices, said cable having high capacity for work at maximum loads of 30% of breaking strength, and said wires being separable and resistant to strainhardening under pressure and workload, wherein:

efficiency of said cable is between 88% and 95%, linear loading is not less than 80% of breaking strength having balanced dynamic, mechanical and physical properties to said level, and wherein:

said wires having versatile strength including high strength-to-weight ratio in excess of $11\times10^5$, high torsional strength in helices in excess of 80 torsions at a density of 0.16 lbs. per cu. in., and high linear strength in excess of 85% of ultimate breaking strength in said cable, and having high drop tear test energy in excess of 750 ft. lbs., whereby said cable limits stresses induced, and fatigue flaws do not occur.

2. A cable made of a plurality of ti wires, as in claim 1, wherein said low cable modulus and high spring constant, and Poisson's ratio of about 0.3 combine to produce low Hertzian contact stresses ($\sigma\tau$) between said wires, strands, layers and cable layers, and wherein microstructure strainhardening of said wires stops after limited microyielding under workload, whereby said cable is fatigue resistant.

3. A cable made of a plurality of ti wires, as in claim 1, wherein said wires being primarily of alpha ($\alpha$) phase ti, and of beta ($\beta$) phase ti, and said wires having high drop tear energy in excess of 750 ft. lbs., and wherein said microstructural strain-hardening condition also resists atom unbonding while performing said work.

4. A cable made of a plurality of ti wires, as in claim 1, wherein said cable is contrahelically layered with a core having short lay lengths between ½" and 5", and high preform angles not to exceed 30° to induce counterbalancing action under primary loads, and wherein stretch exceeds 1% to moderate stress concentrations, whereby dynamic stress and fatigue effects do not develop flaws.

5. A cable for use in the process of conversion of strain and kinetic energy comprising a helically laid core having a plurality of separable, non-ferrous wires, and two contrahelical layers having a plurality of separable ti wires, each component having short lay lengths of approximately equal axial stretch by which means energy interchange in said cable is rapid while performing work including energy interexchange when energy is induced into said cable, wherein mass density ($\rho$) is low wire density averaging 0.14–0.15 lbs per cu. in., cable modulus of elasticity ($E_c$) being between $8\text{–}12\times10^6$ psi as controlled by short lay lengths between ½" and 5" in said core and layers, and high soft spring constant being inversely proportional to said cable modulus, and wherein said ti wire having versatile strength including high strength-to-weight ratio in excess of $11\times10^5$, high torsional strength in excess of 80 torsions at a density of 0.16 lbs. per cu. in. in said ti helices, and having high hard wire spring at an average gap of 5% between yield and ultimate strengths, and whereby wide amplitude stress vibration and axial counterbalancing action induces energy interchange, avoids stress concentrations and limits impact wave reflections.

6. A cable for use in the process of conversion of strain and kinetic energy, as in claim 5, wherein property groups are balanced including, viz: (1) dynamic group having said cable modulus for absorbing and storing energy and said soft spring and wide amplitude vibration for dissipating energy, (2) mechanical group having said versatile strength and linear deflection, and (3) physical group having limited strainhardening and high drop tear energy in excess of 750 ft. lbs., and wherein said wire helices have axial stretch not in excess of 2%, transverse vibratory amplitude not in excess of 1% in separating wires against Hertzian stresses, whereby cable serviceability is protracted.

7. A cable for use in the process of conversion of strain and kinetic energy, as in claim 5, wherein dynamic stresses are rapidly propagated through said separable wires and layers, instantly following wave propagations according to dynamic relations, viz: (1)$\sqrt{e/\rho}$ and (2)$\sqrt{\sigma/\rho}$ in f.p.s., axially and transversely, respectively, wherein said propagation is disturbed by dynamic stresses and stress concentrations, and said stresses and concentrations are avoided and moderated, and whereby cable stress and fatigue is controlled.

8. A composite cable for use in energy conversion and handling control comprising a core of helically laid, non-ferrous, insulated wires including a layer of ti wires embedded in said insulation, and a contrahelical, outer layer of ti and aluminum (al) wires said cable having balanced right and left hand torsional forces under tension, and wherein said cable has low mass density ($\rho$) between 1 and 1.5 lbs per lineal ft., a cable elastic modulus ($E_c$) between 8 to $12\times10^6$ psi, short lay lengths in said core and outer layers with stretch not in excess of 2%, and wherein said al and ti wires are separable and are surface peened by stress vibration impacts, and have high drop tear test energy, viz: al in excess of 400 ft. lbs. and ti in excess of 750 ft. lbs., and wherein stress vibration of said core is damped, and said core and said outer layer are two separable dynamic components, and whereby, viz: (1) cable rotation is not induced by torsional forces, stress concentrations are limited and occur only at cable bends, and stresses are stratefied for rapid energy conversion through separable wires and components.

9. A wire for use in the process of energy conversion, said wire being made of ti and formed into a helix, wherein the modulus of elasticity ($E_w$) is approximately $16\times10^6$ psi and the spring constant is inversely proportional to said modulus, and having not less than 750 ft. lbs. drop tear energy, and wherein said wire does not microyield under load deflection of 60%, and whereby energy is rapidly interchanged axially and transversely under normal loading, and when in cable structures does not develop flaws.

10. A wire for use in energy conversion, as in claim 9, said wire having versatile strength including high torsional strength of greater than 80 torsions at a density of about 0.16 lbs. per cu. in., linear deflection in excess of 88% of breaking strength, high compressive strength in excess of 145,000 psi, and atom unbonding does not occur, whereby fatigue is not a flaw in cable structures.

11. A wire for use in energy conversion, as in claim 9, said wire being made of aluminum (al), wherein said wire is non-frangible having drop tear energy in excess of 400 ft. lbs., and versatile strength including a strength-to-weight ratio averaging $9\times10^5$, torsional strength of greater than 25 torsions at a density of 0.10 lbs per cu. in., a breaking strength of not less than 70,000 psi and in excess of 100,000 psi, and linear deflection in excess of 85% of breaking strength, and wherein dynamic properties of said wire are high including said density, a low modulus of elasticity, $E_w$, averaging $10\times10^6$ psi, and spring constant being inversely proportional to said modulus, whereby in cable structures mass density, primarily in composite cables, is lowered and dynamic properties are increased.

* * * * *